United States Patent [19]

Saunders

[11] Patent Number: 4,648,376

[45] Date of Patent: Mar. 10, 1987

[54] SELF CLEANING PRESSURE BUTTON

[76] Inventor: Charles A. Saunders, 8380 - 36th Ave., Columbus, Nebr. 68601

[21] Appl. No.: 749,808

[22] Filed: Jun. 28, 1985

[51] Int. Cl.[4] ..... F41D 10/00

[52] U.S. Cl. ..... 124/41 A

[58] Field of Search ..... 124/41 A, 24 R; 267/8 R, 8 D

[56] References Cited

U.S. PATENT DOCUMENTS

| | | | |
|---|---|---|---|
| 3,232,286 | 2/1966 | Guyton | 124/24 R |
| 3,482,563 | 12/1969 | Pint | 124/24 R |
| 4,170,980 | 10/1979 | Killian | 124/41 A |

*Primary Examiner*—Richard C. Pinkham
*Assistant Examiner*—Benjamin Layno
*Attorney, Agent, or Firm*—Henderson & Sturm

[57] ABSTRACT

An improved pressure button for an archery bow having a housing adapted to extend through an opening in a bow handle. The housing has a chamber disposed therein and the chamber extends to an opening in one end thereof. A plunger is slidably disposed within the chamber and the plunger has one end thereof extending through the opening and forming a small space between the one end of the plunger and the housing. An arrow contacting portion is disposed on one end of the plunger for contacting an arrow on an arrow rest, such arrow rest being attached to the bow handle. A spring is disposed within the plunger for biasing the plunger in a direction toward the arrow and a stop is provided for preventing the plunger from moving too far in such one direction. An opening is provided for permitting air to enter the chamber on the other end thereof and a pump is disposed within the chamber for causing air to be forced out through the space between the housing and the plunger when the plunger operates as a shock absorber and guiding mechanism for the arrow when it is shot. A filter is provided in the chamber to prevent dirt from entering the chamber.

1 Claim, 8 Drawing Figures

SELF CLEANING PRESSURE BUTTON

TECHNICAL FIELD

The present invention relates generally to an attachment for archery bows, and more particularly to a pressure button apparatus having a self-cleaning feature.

BACKGROUND ART

When an arrow is shot from a bow there is sometimes a tendency for the arrow to wobble from side-to-side, especially if the archer has not executed the release of the arrow properly. Pressure buttons have been devised and have been in use for many years which extend through the handle of a bow and have a surface thereon for contacting the arrow as it rests on an arrow rest. This pressure button, in combination with an arrow rest, holds the arrow in a predetermined position and then once the arrow is shot, it operates as a guide and as a shock absorber to take some of the side-to-side wobble out of an arrow which has been released poorly. These pressure buttons typically have a compression spring inside a housing extending through the window section of a bow above the bow handle. The spring pushes the arrow contact portion to a predetermined position, in which the position is typically adjustable.

Pressure buttons of the aforementioned type necessarily include a space between the plunger and the housing for permitting the plunger to move in and out with respect to the housing. If dust or dirt gets into this space between the plunger and the housing, then the plunger will not easily move and reciprocate with respect to the housing and it needs to do in order to function properly. This can be a particular problem when it is on a bow being used for hunting or a bow which is outdoors in the field.

Consequently, there is a need for an apparatus for keeping a pressure button plunger clean and free of dirt and dust so that it will reciprocate freely in the fashion to which it was designed.

DISCLOSURE OF THE INVENTION

The present invention relates to an improved pressure button for an archery bow having a housing adapted to extend through an opening in a bow handle. The housing has a chamber disposed therein and the chamber extends to an opening in one end thereof. A plunger is slidably disposed within the chamber and the plunger has one end thereof extending through the opening and forming a small space between the one end of the plunger and the housing. An arrow contacting portion is disposed on one end of the plunger for contacting an arrow on an arrow rest, such arrow rest heing attached to the bow handle. A spring is provided within the plunger for biasing the plunger in a direction toward the arrow and a stop is provided for preventing the plunger from moving too far in such one direction. An opening is provided for permitting air to enter the chamber on the other end thereof and a pump is disposed within the chamber for causing air to be forced out through the space between the housing and the plunger when the plunger operates as a shock absorber and guiding mechanism for the arrow when it is shot. A filter is provided in the chamber to prevent dirt from entering the chamber.

An object of the present invention is to provide an improved pressure button for an archery bow.

Another object of the present invention is to provide a pressure button of the aforementioned type which is self-cleaning.

A further object of the present invention is to provide a pressure button of the aforementioned type which has an air pump therein for causing air to flow past the plunger and housing.

Other objects, advantages, and novel features of the present invention will be apparent from the following detailed description of the invention when considered in conjunction with the accompanying drawings.

BEST MODE FOR CARRYING OUT THE INVENTION

Figure 1:
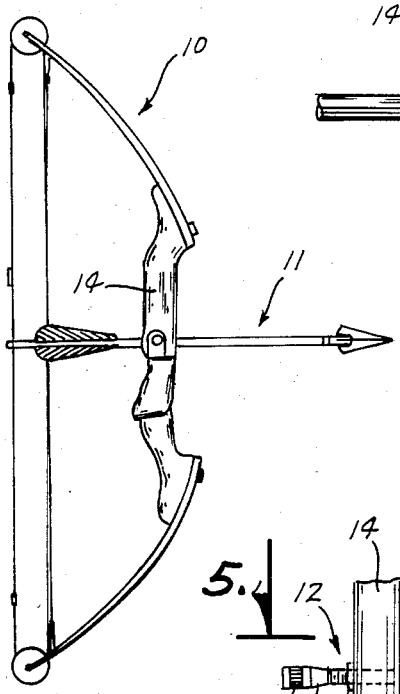
FIG. 1 is a side elevational view of a bow having an arrow in a position ready to be shot therefrom.
Figure 2:
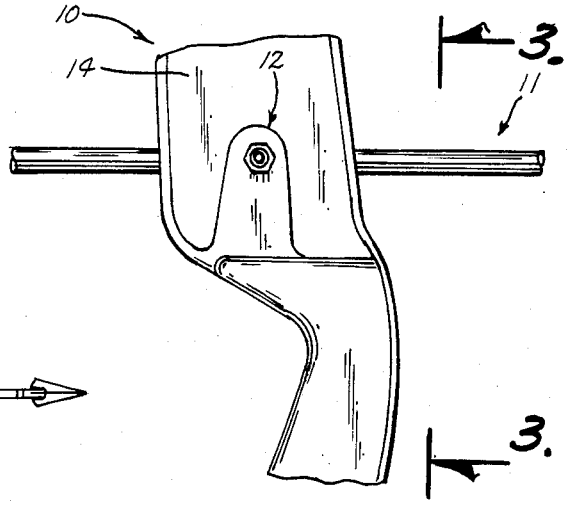
FIG. 2 is an enlarged partial sectional side elevational view of the bow and arrow of FIG. 1 and showing one side of a pressure button structure extending through the handle of the bow.

Referring now to the drawings, wherein like reference numerals designate identical or corresponding parts throughout the several views, FIG. 1 shows a compound bow (10) having an arrow (11) associated therewith in readiness to be shot from the bow (10). A pressure button (12) constructed in accordance with the present invention is threadably engaged through an opening (13) in the handle section (14) of the bow (10).

Figure 3:
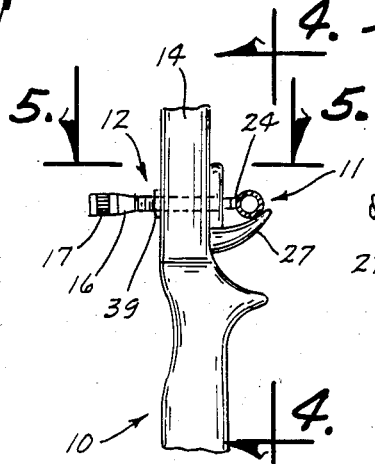
FIG. 3 is a cross sectional view taken along line 3—3 of FIG. 2 showing the pressure button of the present invention.
Figure 4:
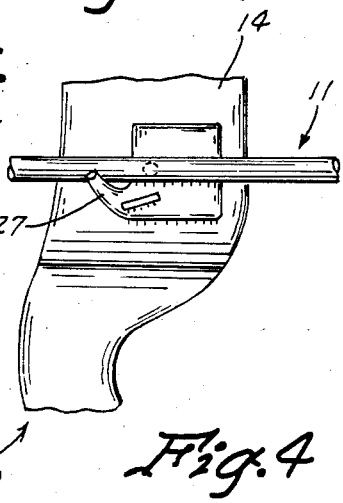
FIG. 4 is a view taken along line 4—4 of FIG. 3.
Figure 5:
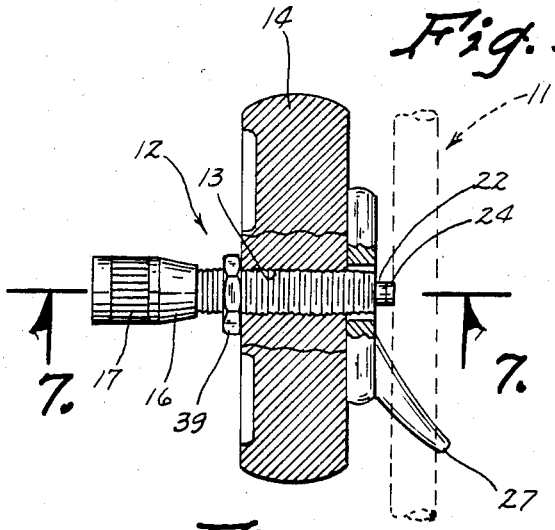
FIG. 5 is a cross sectional view taken along line 5—5 of FIG. 3.
Figure 6:
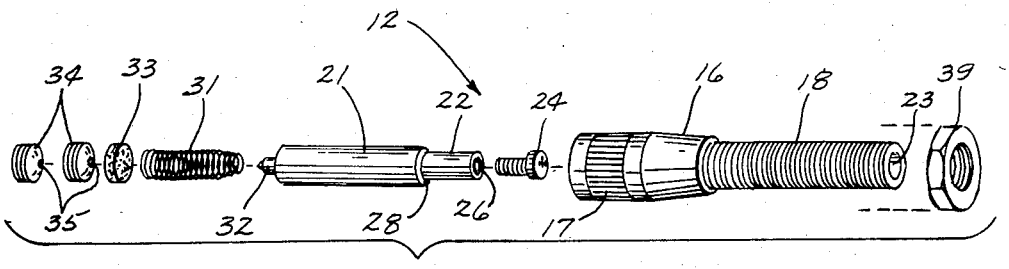
FIG. 6 is an exploded perspective view of a preferred embodiment of the pressure button of the present invention.

The pressure button (12) includes a housing (16) having a knurled portion (17) on one enlarged end thereof and a threaded portion (18) on the other end thereof. The housing has a chamber (19) extending therethrough for receiving a plunger (21). The plunger (21) has one portion (22) thereon which is of a smaller diameter to extend through a reduced diameter section (23) on the interior of the housing (16). A plastic member (24) having a threaded portion (26) on one end thereof is provided for the purpose of contacting the arrow (11) when the arrow is in the position on an arrow rest (27) attached to the bow handle (14), for example as shown in FIGS. 3–5. The member (24) can be replaced or interchanged with other arrow contact members having different made of different materials, if so desired.

Figure 7:
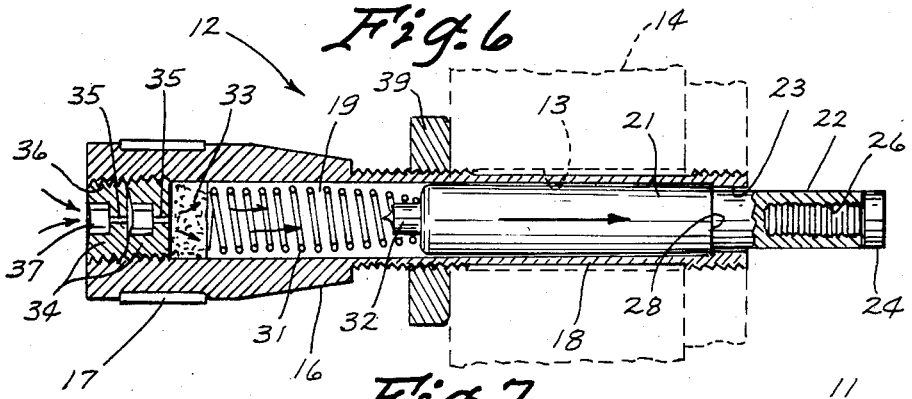
FIG. 7 is an enlarged cross sectional view of the pressure button shown in FIG. 6 taken along line 7—7 of FIG. 5.

A shoulder (28) disposed between the main portion of the plunger (21) and the reduced portion (22) serves as a stop to limit the movement of the plunger (22) to the right when it abuts shoulder (29) on the housing (16), as can best be seen in FIG. 7. A spring (31) is disposed within the chamber (19) and extends over a projection (32) on one end of the plunger (21) for making certain that the spring (31) remains in its proper position within the chamber (19). The other end of the spring (31) is in abutment with a filter (33).

A pair of closure members (34 and 35) are threadably engaged with threads (36) on the interior of the housing (16) and each of these threaded closures (34) has a vent opening (35) therethrough for allowing the intake of air therethrough, past the filter (33), and into the interior of the housing (19). Because the openings (35) are small and the filter material (33) somewhat dense, the air can seep in slowly to the chamber (19), but cannot escape quickly through the filter (33) and openings (35). Depressions (37) in each of the members (34) is for receiving an Allen wrench to permit the closures (34) to be rotated in or out of the housing (16).

Referring to FIG. 7, it will be noted that the housing (16) can be moved in or out to adjust the position of the end (24) of the pressure button (12) by rotating the member (16) and threading it in or out of the handle (14) as desired. Once the housing (16) and the end (24) of the pressure button (12) is in the position desired, then a locking nut (39) is utilized to be tightened down against the handle surface in order to ensure that the housing (16) will not rotate with respect to the handle section (14), so that the end (24) will always be in the proper position to guide the arrow (11) when it is to be shot from the bow (10).

Figure 8:
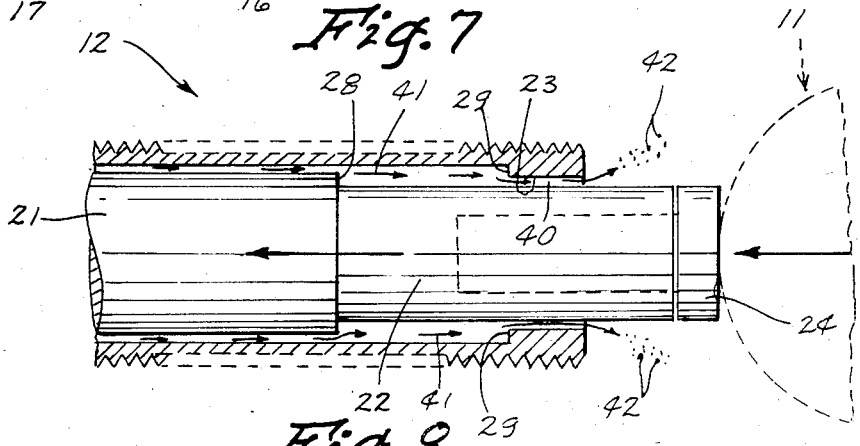
FIG. 8 is an enlarged cross sectional view like FIG. 7 but showing the end of the pressure button shown in FIG. 7 to illustrate how air is pumped through the small space between the end of the pressure button and the housing of the pressure button for the purpose of pumping air therethrough to clean out dirt and dust which otherwise accumulates in such space.

When the arrow (11) is shot from the bow (10), for example starting from the position shown in Fig. 1, and referring to FIG. 7, the arrow (11) will tend to push the plunger (21) from the position shown in FIG. 7 to the position shown in FIG. 8. When this occurs, the plunger (21) will compress the air within the chamber (19) and this air will be forced past the plunger and out through the opening (40) which is a space between the reduced section of the plunger (22) and the surface (23) of the housing (16). When this occurs, the air moving along as indicated by the arrows (41) will force dirt (42) out of such space, thereby accomplishing the self-cleaning function referred to above.

Accordingly, it is believed that the preferred embodiment shown herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. An improved pressure button for an archery bow comprising:

a housing adapted to extend through an opening in a window section of a bow disposed above a bow handle;

means for forming a chamber within said housing, said chamber means having an opening on one end thereof;

a plunger slidably disposed in said chamber, said plunger having one end thereof extending through said opening and forming a small space between said one end of the plunger and said housing;

arrow contact means disposed on one end of said plunger for contacting an arrow supported on an arrow rest attached to a bow handle;

means for biasing said plunger in one direction;

stop means for preventing said plunger from moving too far in said one direction;

means for venting air into said chamber;

pump means for causing air to be forced out of said small space between said one end of the plunger and said housing and past said one end of the plunger when said plunger is pushed in the other direction against the bias of said biasing means for forcing dirt from said space to insure that the plunger remains clean and in good working order; and means for filtering the air passing through said venting means to prevent dirt from entering said chamber.

* * * * *